United States Patent [19]

Morgan

[11] Patent Number: 4,857,879

[45] Date of Patent: Aug. 15, 1989

[54] DROP-OUT EXPULSION FUSE

[75] Inventor: David E. Morgan, Carlingford, Australia

[73] Assignee: Brown Boveri (Australia) Pty, Limited, Marayong, Australia

[21] Appl. No.: 210,401

[22] Filed: Jun. 23, 1988

[30] Foreign Application Priority Data

Jul. 2, 1987 [AU] Australia ..... PI2846

[51] Int. Cl.[4] ..... H01H 71/10; H01H 85/02

[52] U.S. Cl. ..... 337/173; 337/168; 337/203

[58] Field of Search ..... 337/167, 168, 169, 170, 337/171, 172, 173, 174, 175, 176, 177, 178, 179, 180, 181, 185, 202, 203, 205, 206, 207, 208, 249, 217, 222, 280

[56] References Cited

U.S. PATENT DOCUMENTS 2,689,284 9/1954 Hill ..... 337/173

2,877,320 3/1959 Hill ..... 337/173

*Primary Examiner*—H. Broome

*Attorney, Agent, or Firm*—Pearne, Gordon, McCoy & Granger

[57] ABSTRACT

An ejecta trap for a drop out expulsion fuse of the type comprising an elongate insulating body with a conductive head fitting and tail socket. The tail socket is pivotally connected to the tail fitting and the head and tail fittings are adapted to electrically and mechanically engage respective head and tail terminals. A fuse means is connected within the body between the head and tail fittings. The ejecta trap is pivotally mounted on the tail terminal such that it may be swung between an in-use position immediately below the tail fitting where it collects ejected fuse means material and another position.

8 Claims, 6 Drawing Sheets

DROP-OUT EXPULSION FUSE

This invention relates to drop-out expulsion fuses of the kind used for the protection of overhead, electric power transmission and distribution systems.

Simple expulsion fuses conventionally comprise a tubular insulating body with a metallic head fitting at one end and a metallic tail fitting at the other. Those fittings are adapted to electrically and mechanically engage respective head and tail terminals of a fuse holder, in turn adapted for connection to incoming and outgoing portions of an overhead line conductor. A fuse element is positioned within the fuse body and is connected at one end to the fuse head fitting. The other end of the fuse element is connected to a flexible, conducting pigtail which extends through the body to the tail fitting, to which it is connected.

When the current in the line conductor exceeds a predetermined value for a predetermined time the fuse element melts and an arc is created between the fuse head fitting and the adjacent end of the pigtail. The heat of the arc causes the material of the body, or a lining thereon, to produce copious amounts of steam and/or de-ionising gas which violently expels the pigtail from the fuse body to lengthen and extinguish the arc and so open circuit the line conductor; hence, the name expulsion fuse.

In the case of a drop-out expulsion fuse the tail fitting is in two parts pivotally or otherwise linked together. The two parts of that fitting are normally held fixedly each to each by tension in the pigtail; which tension is usually maintained without stressing the fuse element by means of a strain cord in parallel with the fuse element which, like the fuse element, is mechanically connected at its ends to the fuse head fitting and one end of the pigtail respectively. When the fuse element melts the strain cord is destroyed and that tension disappears. This allows the two-part tail fitting to collapse causing the head fitting to retract from its engagement with the holder head terminal which, in turn, allows the fuse body to swing downwardly under the influence of gravity to a fully isolating drop-out position. The fact that a fuse has dropped out may readily be observed from ground level enabling the blown fuse to be identified and replaced more quickly than otherwise would be the case.

When a fuse operates remnants of the pigtail, fuse element and strain cord are forcefully expelled from the bottom end of the fuse body. Such ejecta are sometimes hot enough to cause fires and are always apt to cause injury to a linesman or other person they may strike. Thus it is commonplace to provide an ejecta trap below the fuse body adapted to receive and contain solid or massive ejecta without substantially impeding the emission of gas from the fuse body.

The ejecta trap may be an open topped container with a floor or rear wall in the form of a plurality of sheets of metal gauze, perforated metal plates or the like. It may include internal partition walls or fins adapted to split and cool the outflowing gas. Whatever its form the ejecta trap has necessarily been positioned immediately below the bottom fuse holder terminal and thus has constituted an objectionable obstruction to a linesman when working, usually on a ladder, from below the fuse either to remove a blown fuse or replace it with a fresh fuse. The obstruction is the more objectionable as such a linesman is usually obliged to manipulate the fuse by means of a hook-stick or the like calling for straight line access to the lower fuse holder terminal.

Notwithstanding their above indicated objectionable feature, ejecta traps are in widespread use because of their need as a safety measure.

An object of the present invention is to overcome the above indicated disability of prior known ejecta traps by very simple means.

According to the invention there is provided a drop-out expulsion fuse of the type comprising an elongate insulating body with a conductive head fitting and tail socket, the tail socket being pivotally connected to a tail fitting, and the head and tail fittings being adapted to electrically and mechanically engage respective head and tail terminals, fuse means connected within the body between the head and tail fittings, and an ejecta trap to collect ejected fuse means material; wherein the trap is pivotally mounted on the tail terminal such that it may be swung between an in-use position immediately below the tail fitting and another position.

Advantageously the trap co-operates with the tail socket such that movement of the fuse to its operative position causes the trap, if not in its in-use position, to be swung to its in-use position. Preferably the tail socket holds the trap in the in-use position when the fuse is in its operative position. In order to achieve this the trap preferably comprises an abutment which co-operates with the tail socket. Also the fuse means preferably comprises a fuse connected to the head fitting, and a pigtail extending from the fuse and connected to the tail fitting by means of a clamp screw, the clamp screw preferably has a large screw head which co-operates with said abutment means.

Also advantageously, the trap may be swung between the in-use position at one extreme of its travel and another position at the other extreme of its travel as defined by stop means. Spring means may bias the trap to the position at said other extreme of its travel. Alternatively the spring means may bias the trap into one or other of the two extremes of its travel depending upon its position between the two extremes.

The invention will now be described by way of example only with reference to the accompanying drawings, in which.

Figure 1:
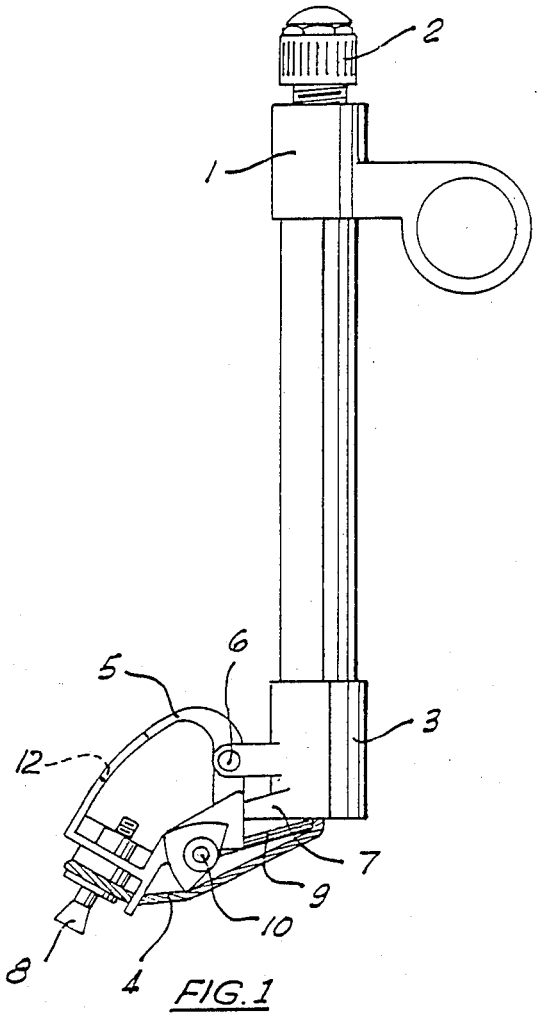
FIG. 1 is a fuse holder in combination with head and tail fittings, when ready for use.

Referring now to FIG. 1 fuse holder 1 has a head fitting 2 at one end and a tail socket 3 at the other end. A fuse (not shown) is attached to head fitting 2 inside fuse holder 1 and a pigtail 4 extends from the fuse and out of the tail end of the fuse holder. Tail socket 3 is rotatably connected to tail fitting 5 about axis 6, and a stop 7 provided on tail socket 3 co-operates with tail fitting 5 and limits their relative rotation in one direction.

Before use the tail socket and tail fitting are rotated to the limit of their travel against stop 7 and braced in this relationship by means of pigtail 4. The free end of pigtail 4 being connected to tail fitting 5 by means of a clamp screw 8. A spring biased member 9 is held down against the bias by pigtail 4 when it is clamped to tail fitting 5. Two cylindrical pins 10 extend, one from either side, of tail fitting 5.

Figure 2:
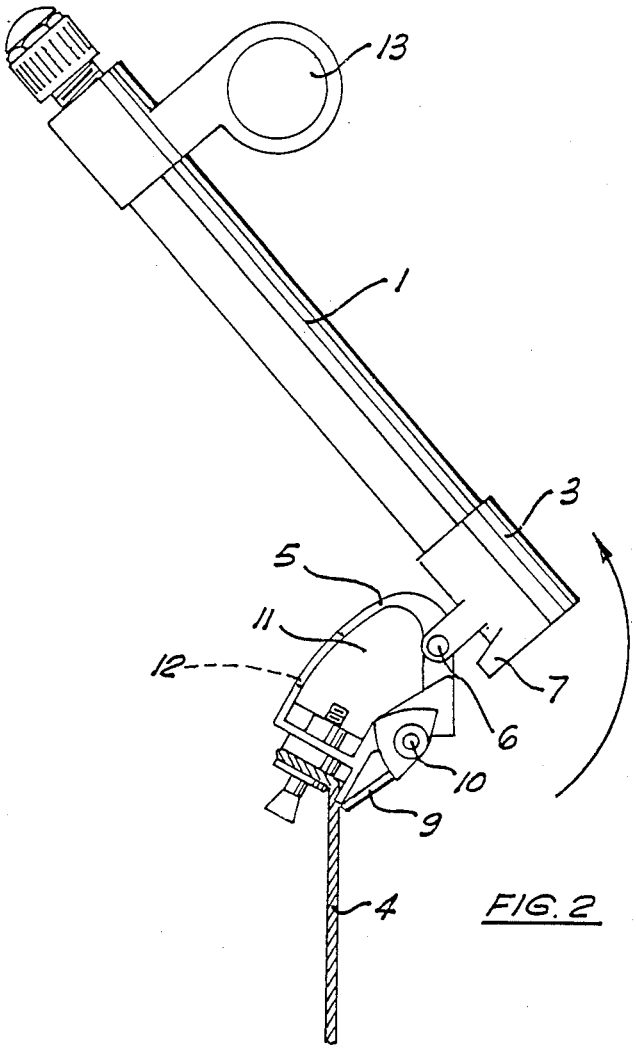
FIG. 2 is the fuse holder of FIG. 1 after the fuse has blown.

When the fuse blows spring biased member 9 flicks pigtail 4 from inside the fuse holder 1, and allows fuse holder 1 and tail fitting 5 to rotate with respect to each other about axis 6, as shown in FIG. 2.

Tail fitting 5 is penetrated by a hole 11, and preferably another hole 12 in order to allow it to be manipulated by a hook-stick. A ring 13 extending from the body of fuse holder 1 is also provided to allow manipulation of the fuse holder by a hook-stick, and in particular this ring is used to load the fuse into its in-use position.

Figure 3:
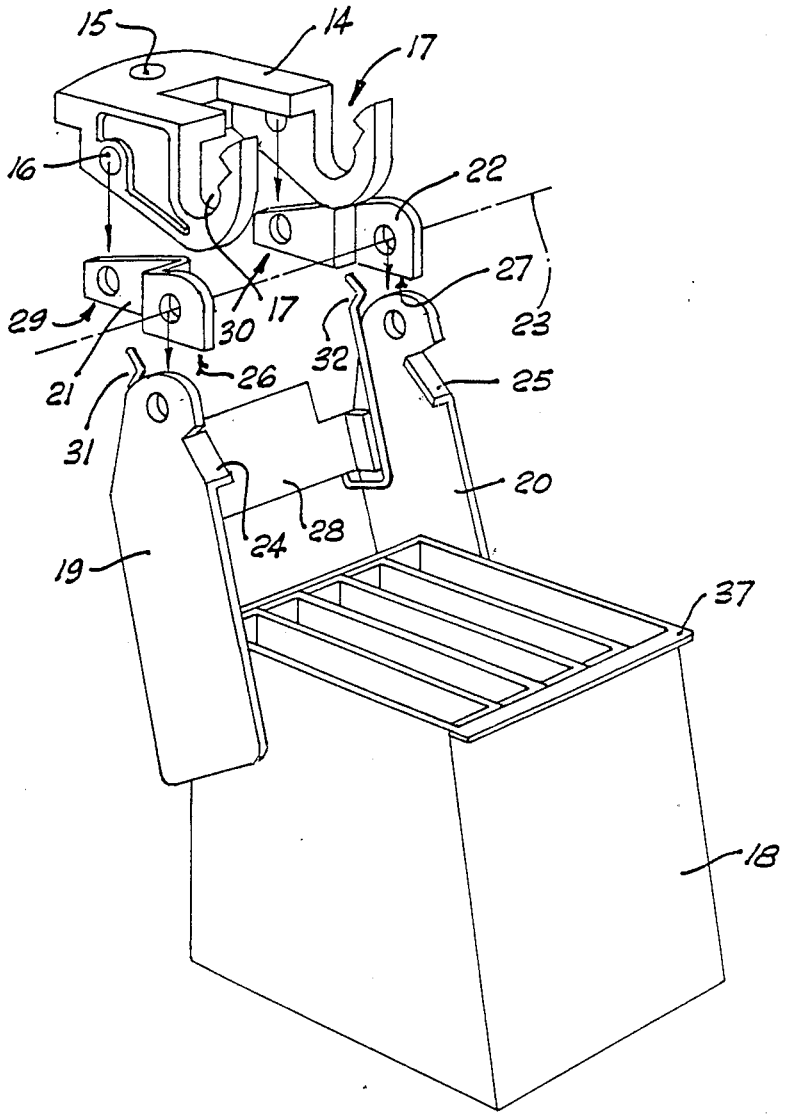
FIG. 3 is an exploded perspective view of an ejecta trap and tail terminal arrangement according to a preferred embodiment of the present invention.

Referring now to FIG. 3 tail terminal 14 is penetrated by a hole 15 to allow it to be bolted to the fuse base. Tail terminal 14 has side plates on either side which are each penetrated by corresponding holes 16, and which extend to form U-shaped front parts 17.

Hitherto an ejecta trap would be secured to tail terminal 14 by means of plate-like extensions of the trap's container sidewalls which embrace respective side plates of the tail terminal and are bolted flatly thereagainst. However, in accordance with the embodiments of the invention now being described the trap 18 has two plate-like side extensions 19 and 20 which are connected to the side plates of tail terminal 14 by means of respective bracket means 21 and 22. Bracket means 21 and 22 are bolted in fixed relation to tail terminal 14 but rotatably connected to side extensions 19 and 20. In this way trap 18 may rotate about axis 23.

Trap 18 is limited in its rotation about axis 23 in the anti-clockwise direction by stops 24 and 25. These stops consist of lateral flanges on side extensions 19 and 20 which are turned in and which co-operate with edges 26 and 27 of brackets 21 and 22. Rotation in the clockwise direction is prevented from exceeding the desired limit by a cross-member 28 which spans between side extensions 19 and 20 and which co-operates with edges 29 and 30 of brackets 21 and 22. Parking springs 31 and 32 may be provided to urge and retain trap 18 in the two stopped positions at either end of its travel.

Figure 4:
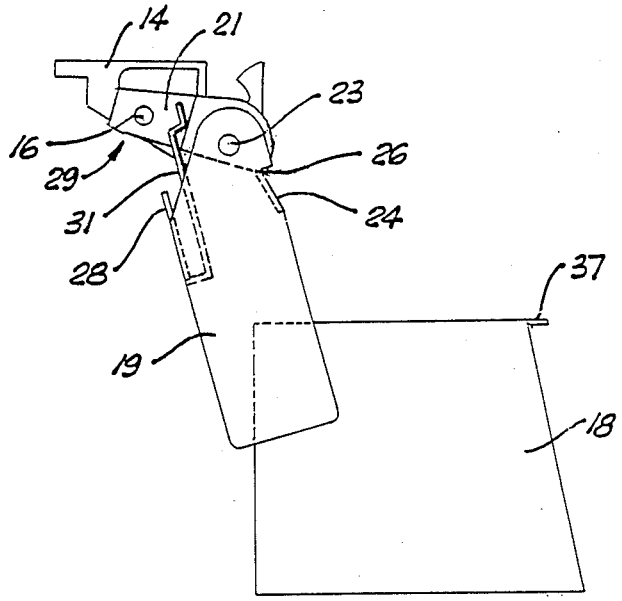
FIG. 4 is an elevation of the arrangement of figure 3 when the trap is in the in-use position.
Figure 5:
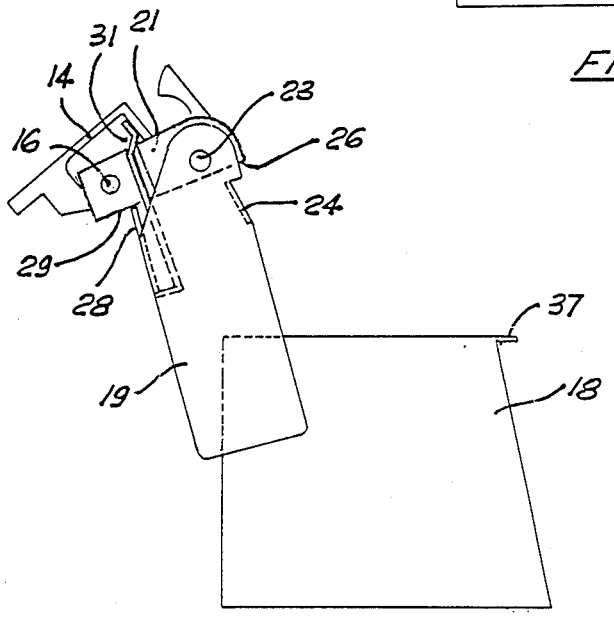
FIG. 5 is an elevation of the arrangement of figure 3 when the trap is in the out-of-use position.

FIGS. 4 and 5 illustrate the arrangement in the two positions at either extreme of travel, in the in-use and out-of-use positions respectively.

Figure 6:
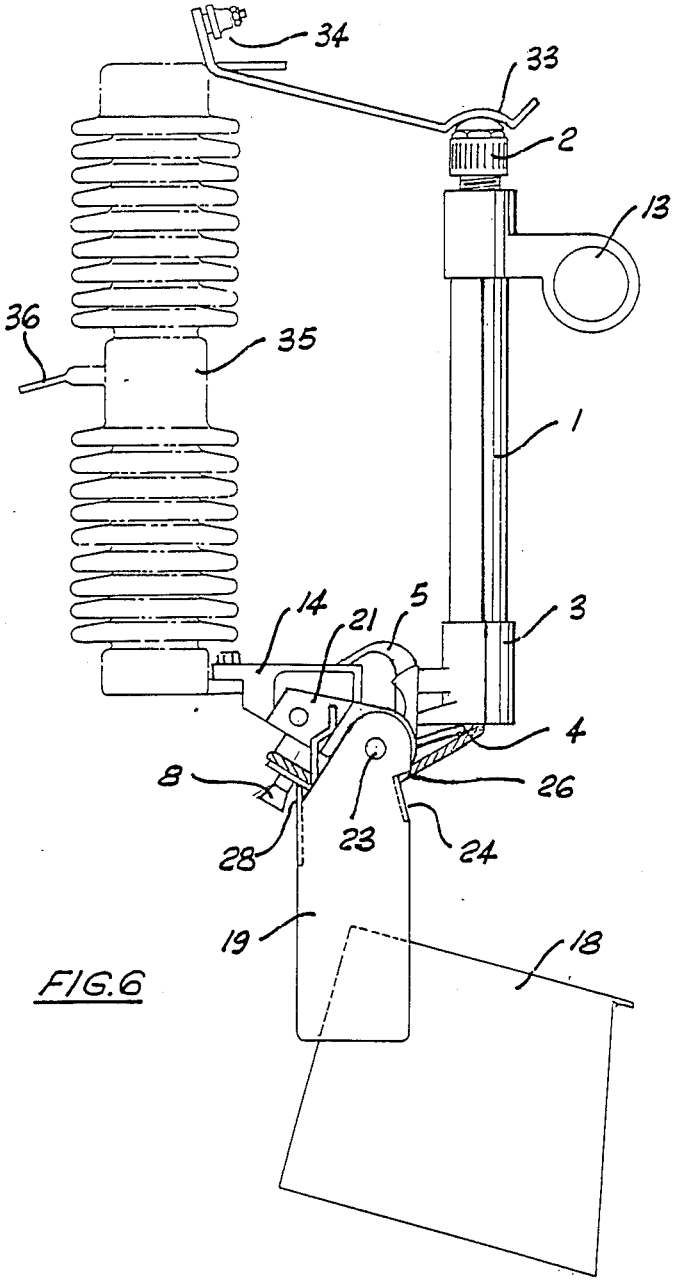
FIG. 6 is an elevation of an entire drop-out expulsion fuse embodying the present invention when in the in-use position.
Figure 7:
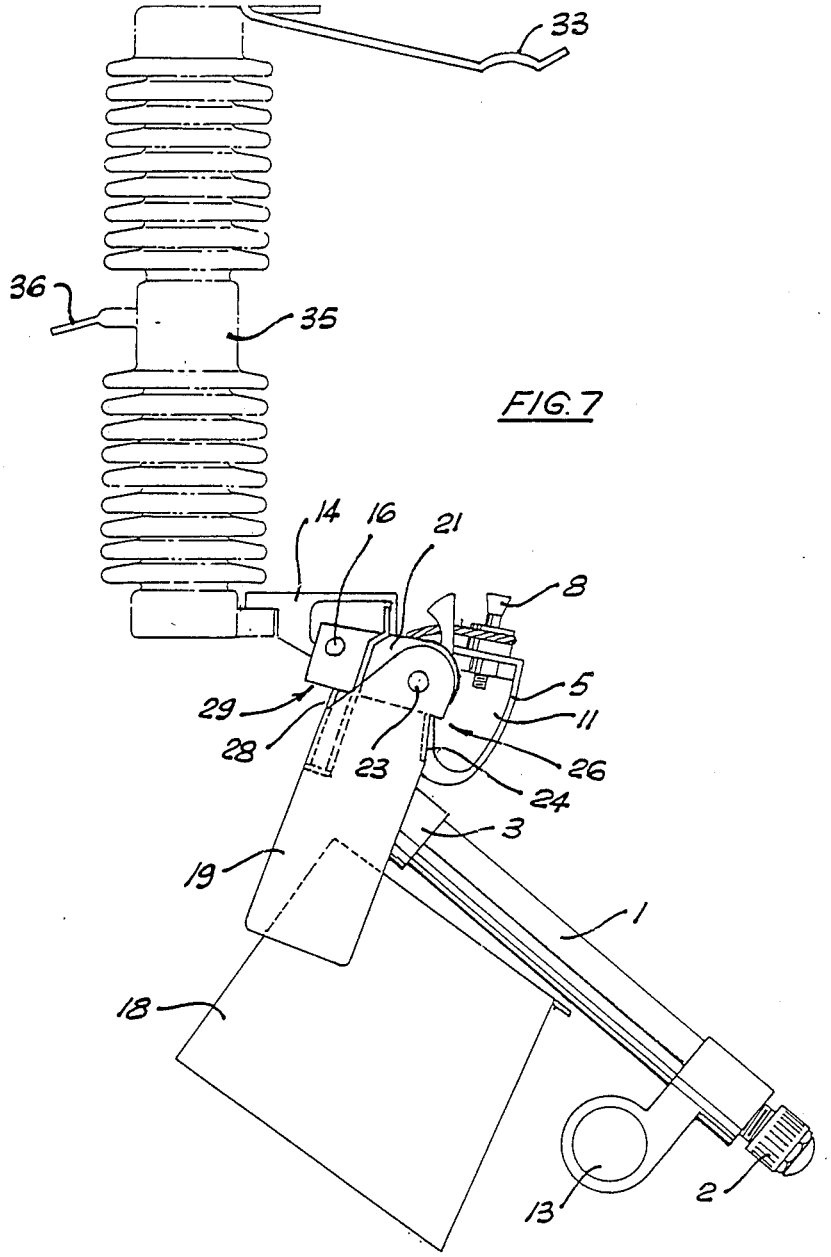
FIG. 7 is the fuse shown in FIG. 6 when in the fuse blown position.

The side plates of tail terminal 14 are formed into U-shaped front parts 17. These are positioned a sufficient distance apart to allow the tail fitting 5 of the fuse holder to be hung onto the tail terminal by means of the pins 10. In use the fuse holder is prepared as described in relation to FIGS. 1 and 2 and is then hung onto tail terminal 14 in the orientation indicated in FIGS. 6 and 7.

The fuse holder 1 is then pushed into a substantially upright position, by means of a hook-stick which engages with ring 13, until head fitting 2 engages a head terminal 33. Head terminal 33 is connected to a conductor by means 34 and to tail terminal 14 by means of an insulator 35. The insulator is typically mounted centrally, by means of a mounting bracket 36 connected to a supporting super-structure. Typically the arrangement is such that the axis of the insulator is at approximately 18° to the vertical. When fuse holder 1 is swung up into the in-use position the head of clamping screw 8 engages behind the cross member 28 and urges trap 18, if it is not ready in the in-use position, into the in-use position. The head of clamping screw 8 thereafter maintains the trap 18 in the in-use position as long as the fuse holder 1 is in the in-use position.

Preferably, but not essentially, fuse holder 1 may swing from pins 10 about substantially the same axis as the trap 18 turns, namely 23.

When the fuse blows and pigtail 4 is flicked out of fuse holder 1, the fuse holder rotates with respect to tail fitting 5 in an anti-clockwise direction as indicated on FIG. 2, simultaneously tail fitting 5 rotates in a clockwise direction with respect to tail terminal 14 about axis 23. This "collapse" action allows the head fitting 2 to disengage from head terminal 33 and thereafter fuse holder 1 rotates in a clockwise direction and falls under gravity until it strikes trap 18. A lip 37 is provided on trap 18 in order to prevent damage to fuse holder 1 when this happens. Pigtail 4 is usually flicked into trap 18 along with the material ejected from fuse holder 1.

A linesman may inspect the fuse from ground level and determine that it has blown due to the attitude of fuse holder 1. In order replace the fuse, fuse holder 1 together with its head and tail fittings must be lifted from tail terminal 14, usually by means of a hook-stick which co-operates with either hole 11 or 12. In order to make this procedure easier trap 18 may be pushed from the in-use position to the out-of-use position before the fuse holder is removed. Once a new fuse and pigtail has been installed in the holder it is returned to the tail terminal by means of the hook-stick. Then fuse holder 1 is swung back up into engagement with head terminal 33, thereafter the fuse may be returned to service. Should trap 18 not be returned to the in-use position before fuse holder 1 is returned to engagement with head terminal 33, then the co-operation of the head of clamp screw 8 with cross-member 28 will ensure that it is moved to the in-use position as the fuse is returned to its service position.

Although the invention has been described with reference to a specific embodiment it should be appreciated that the invention could be embodied in many other ways. For instance the parking spring arrangement is optional. An alternative may be to bias trap 18 only to its out-of-use position, or, no bias need be used but the arrangement could rely on the natural stiffness of the mechanism to maintain the trap in the desired position. It should also be realised that the described stop means are purely for illustration only and that many other arrangements are possible, some of which may use existing elements of the device, while others may rely on tongues or other elements being added to the mechanism. Of course, it should be realised that stops are not strictly necessary although they are helpful in defining the in-use position which must be between certain limits depending on the size of trap 18.

I claim:

1. In a drop-out expulsion fuse of the type comprising an elongate insulating body with a conductive head fitting and tail socket, said tail socket being pivotally connected to a tail fitting, and said head fitting and said tail fitting being electrically and mechanically engaged to a head terminal and a tail terminal, respectively, fuse means connected within said body between said head fitting and said tail fitting, and an ejecta trap to collect ejected fuse means material; in combination therewith the improvement wherein said trap is pivotally mounted on said tail terminal by pivot means such that said trap may be swung between an in-use position immediately below said tail fitting and another position.

2. A drop-out expulsion fuse as claimed in claim 1 wherein the trap co-operates with said tail socket such that movement of the fuse to its operative position causes the trap, if not in its in-use position, to be swung to its in-use position.

3. A drop-out expulsion fuse as claimed in claim 2 wherein said tail socket holds said trap in the in-use position when the fuse is in its operative position.

4. A drop-out expulsion fuse as claimed in claim 3 wherein said trap includes an abutment which co-operates with said tail socket.

5. A drop-out expulsion fuse as claimed in claim 4 in which said fuse means comprises a fuse connected to the head fitting, and a pigtail extending from said fuse and connected to tail fitting by means of a clamp screw, which clamp screw co-operates with said abutment means.

6. A drop-out expulsion fuse as claimed in claim 1 wherein said trap may be swung between said in-use position at one extreme of its travel and another position at the other extreme of its travel as defined by stop means.

7. A drop-out expulsion fuse as claimed in claim 6 wherein a spring means biases said trap to the position at said other extreme of its travel.

8. A drop-out expulsion fuse as claimed in claim 6 wherein a spring means biases said trap into one or other of the two extremes of its travel depending upon its position between the two extremes.

* * * * *